US005494534A

United States Patent [19]

Leu

[11] Patent Number: 5,494,534

[45] Date of Patent: Feb. 27, 1996

[54] METHOD OF HEAT TREATING AN AMORPHOUS SOFT MAGNETIC ARTICLE

[75] Inventor: Ming-Sheng Leu, Hsinchu, Taiwan

[73] Assignee: Industrial Technology Research Institute, Hsinchu, Taiwan

[21] Appl. No.: 406,063

[22] Filed: Mar. 17, 1995

[51] Int. Cl.[6] ..... C21D 1/04

[52] U.S. Cl. ..... 148/108; 148/121

[58] Field of Search ..... 148/108, 121

[56] References Cited

U.S. PATENT DOCUMENTS 4,769,091 9/1988 Yoshizawa et al. ..... 148/108

FOREIGN PATENT DOCUMENTS 60-245729 12/1985 Japan ..... 148/108

63-11654 1/1988 Japan ..... 148/108

63-179051 7/1988 Japan ..... 148/108

*Primary Examiner*—John Sheehan

*Attorney, Agent, or Firm*—Ladas & Parry

[57] ABSTRACT

Two-stage heat treatment is used to improve the initial permeability and core loss of a soft amorphous magnetic article. The first-stage heat treatment is performed at a temperature less than the curie temperature of the amorphous soft magnetic article by 0°–50° C. for 0–10 hours, while applying a static magnetic field which is larger than 1000 Oe in a first direction which is generally perpendicular to the direction the magnetic article is to be magnetized when used or measured. The second-stage heat treatment is performed at a temperature less than the crystallization temperature of the amorphous soft magnetic article by 0°–100° C. for 0–10 hours, while applying a static magnetic field which is between 50 Oe and 1000 Oe in the first direction. Prior to performing the second-stage heat treatment, the temperature is lowered to room temperature.

11 Claims, 3 Drawing Sheets

METHOD OF HEAT TREATING AN AMORPHOUS SOFT MAGNETIC ARTICLE

FIELD OF THE INVENTION

The present invention relates to a method of heat treating an amorphous soft magnetic article, and in particular to a method of heat treating an amorphous soft magnetic article to increase the initial permeability and reduce the core loss thereof.

BACKGROUND OF THE INVENTION

Amorphous soft magnetic materials, such as Fe, Co or Ni base amorphous magnetic alloys have been widely used in the fabrication of various magnetic components, for example magnetic saturable cores, high frequency transformers and current transducer cores. Recently soft magnetic materials having higher initial permeability and reduced core loss have been required in the manufacturing of scaled-down and high frequency power supplies. Usually amorphous soft magnetic shaped materials are subjected to annealing at a temperature below their crystallization temperature to eliminate the internal stress thereof so as to improve their magnetic properties, in particular the initial permeability and core loss characteristics. The annealing treatment can be conducted without applying a magnetic field or can be conducted in a static magnetic field, applied either in the direction the amorphous soft magnetic shaped materials are magnetized, i.e., so-called longitudinal-field annealing; or in a direction generally perpendicular to the magnetized direction, so-called transverse-field annealing.

U.S. Pat. No. 4,944,805 issued to Kanji Nakanishi discloses a method of heat treating amorphous soft magnetic film layers. The method involves performing a heat treatment after each amorphous soft magnetic(ASM) film has been deposited on a substrate, at a temperature lower than the crystallization temperature and the Curie temperature of the ASM film in a static magnetic field applied either in a direction generally perpendicular to the direction in which a high magnetic permeability for high frequency is to be finally attained in the ASM film or in the principle direction in which the high permeability for high frequency is desired; performing a heat final treatment, after all of the layers of ASM films have been deposited, at a temperature equal to or lower than the temperature for the previous treatment in a static magnetic field applied either in the principle or in a direction generally perpendicular thereto. The purpose of the heat treatment is to reduce magnetic anisotropy.

U.S. Pat. No. 5,114,503 issued to Yoshihito Yoshizawa et al discloses magnetic cores which are obtained by being subjected to a heat treatment at a temperature between a crystallization temperature and a curie temperature, and then to a heat treatment at a temperature less than the curie temperature by about 50° C. in a magnetic field in the direction of the magnetic path of the core. The magnetic cores thus treated have a higher rectangular ratio and a reduced stress relief ratio.

SUMMARY OF THE INVENTION

An object of the invention is to provide a heat treatment for amorphous soft magnetic articles to increase the initial permeability and reduce the core loss thereof.

To attain the above object of the invention, two-stage heat treatment is used in the present invention. The first-stage heat treatment includes performing a heat treatment at a first temperature equal to or less than the Curie temperature of the amorphous soft magnetic article by 0°–50° C. for not more than 10 hours, while applying a static magnetic field which is larger than 1000 Oe in a first direction which is perpendicular to the direction that the article is to be magnetized when used or measured. Prior to performing the second-stage heat treatment, the temperature is cooled to room temperature.

The second-stage heat treatment includes performing a heat treatment equal to or at a second temperature less than the crystallization temperature of the amorphous soft magnetic article by 0°–100° C. for not more than 10 hours, while applying a static magnetic field which is between 50 Oe and 1000 Oe in the first direction. The temperature is then again cooled to room temperature to finish the process.

According to an aspect of the invention, after the first-stage heat treatment, the temperature should be cooled to room temperature at a rate less than 20° C./min.

According to another aspect of the invention, after the second-stage heat treatment, the temperature should be cooled to room temperature at a rate less than 200° C./min.

BRIEF DESCRIPTION OF THE DRAWINGS

The present invention can be more fully understood by referring to the following detailed description and accompanying drawings, which form an integral part of this application.

DETAILED DESCRIPTION OF THE INVENTION

The two-stage heat treatment of the invention is suitable for forming amorphous soft magnetic(ASM) shaped articles having higher initial permeability and reduced core loss, such as ribbons or toroidal cores. The shaped articles are fabricated from amorphous soft magnetic materials such as Co-base alloys, Fe-base alloys, and Ni-base alloys.

The first-stage heat treatment is to refine the internal domain structure of the ASM articles. According to magnetic domain theory, when ASM articles are subjected to a transverse magnetic field, the internal magnetic domains that are parallel to magnetic field will change with the variation of the magnetic field. However, when the magnetic domains that are parallel to the magnetic field become larger, due to the action of small magnetic fields generated by high-frequency alternating current, they can not quickly and completely respond to the variation of the magnetic field, and thus the magnetic permeability can not be optimized. In view of the above fact, the temperature of the first-stage heat treatment according to the method of the invention is chosen to be near the curie temperature of the ASM articles.

According to magnetic principle, it is known that the magnetic moment or magnetic spin of an ASM article is prone to arrange randomly i.e., the magnetization approaches zero, when its temperature is close to the curie temperature. At this time., the internal domain structure is in a demagnetized state, and thus applying a magnetic field which is in a direction generally perpendicular to the direction the article is to be magnetized, i.e., a transverse magnetic filled, will make the magnetic domain structure refine along direction the transverse magnetic field is applied.

The temperature is then cooled to room temperature slowly, for example, at a rate of less than 20° C., preferable 5° C./min to fix the newly formed magnetic domain structure.

In the second-stage heat treatment, the ASM articles are subjected to a smaller magnetic field , for example, less than 1000 Oe in the same direction of the first-stage heat treatment so as to retain the refined magnetic domain structure. The temperature for heat treatment is then raised to a higher temperature, usually a temperature which is less than the crystallization temperature of the ASM articles by 0°–100° C. to eliminate the stress generated during the processing such as casting or rolling of the SAM articles.

The temperature is then cooled to room temperature and the process is finished.

Figure 3:
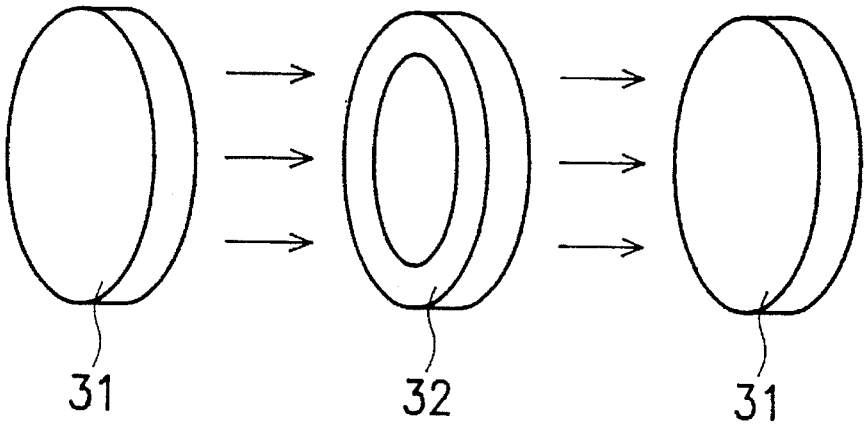
FIG. 3 is a schematic view showing an arrangement of a transverse magnetic field generating device used in Example 1.

According to the invention, the magnetic field generating device used to generate a transverse magnetic field in which the amorphous soft magnetic articles are to be treated can be in various forms. In a simple device, for example, the magnetic field-generating device can consist of two permanent magnets disposed respectively on the two sides of the ASM articles along the direction which is prependicular to the direction in which the ASM articles are to be magnetized when used, so as to apply a transverse magnetic field to the ASM articles. An arrangement of this type is shown in FIG. 3, in which 31, 31 are Sm—Co magnets and 32 is a toroidal core to be applied a transverse magnetic field.

Figure 4:
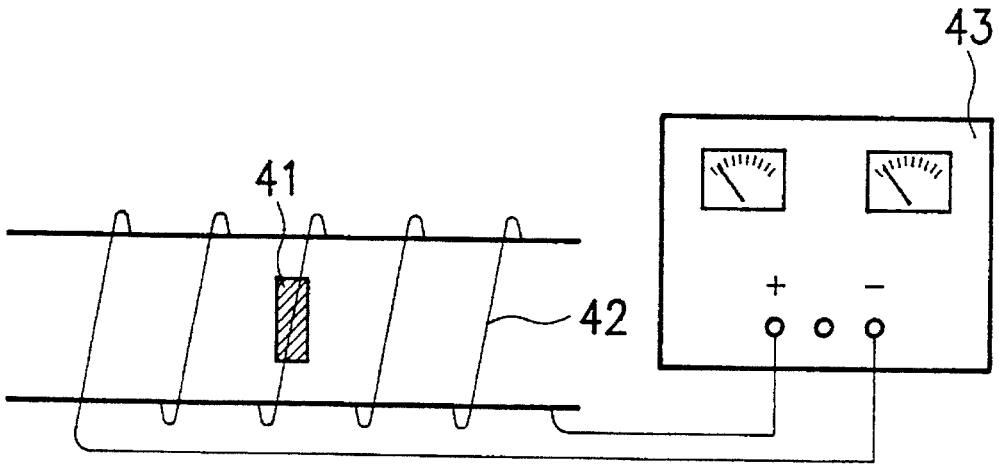
FIG. 4 is a schematic view showing another arrangement of a transverse magnetic field generating device using a solenoid.

The transverse magnetic field can also be generated by using a solenoid, applied thereto a DC or an AC current. Referring to FIG. 4, there is shown a toroidal core 41 which is disposed in the center of a solenoid 42, to which a DC or AC current is applied from a power supply 43.

Figure 5:
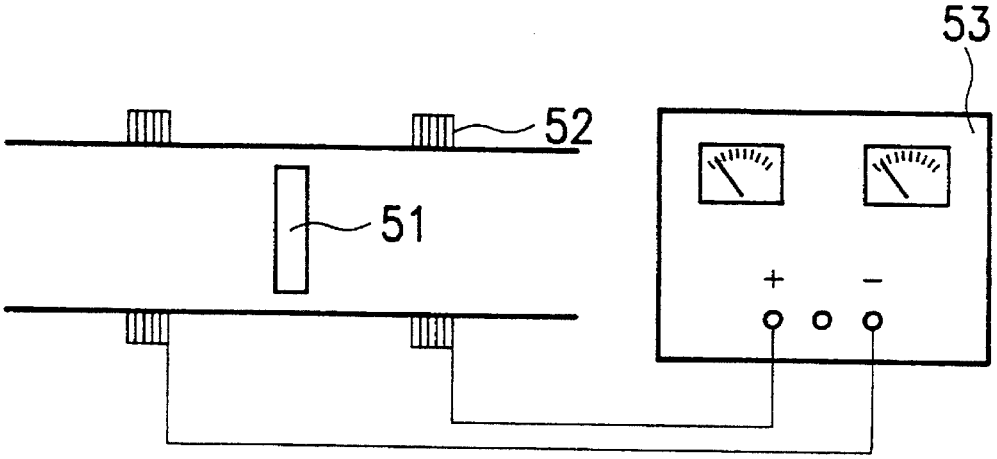
FIG. 5 is a schematic view showing another arrangement of a transverse magnetic field generating device using a plurality of Helmholtz coils.

The transverse magnetic field can also be generated by using a plurality of Helmholtz coils, through which a DC or an AC current is applied. An arrangement of this transverse magnetic field generating device is shown in FIG. 5 in which four Helmholtz coils 52 are disposed around a toroidal core 51 and a DC or AC current is respectively applied to the Helmholtz coils 52 from a power supply 53.

The examples which follow illustrate the method according to the invention without implying any limitation.

EXAMPLE 1

Figure 1:
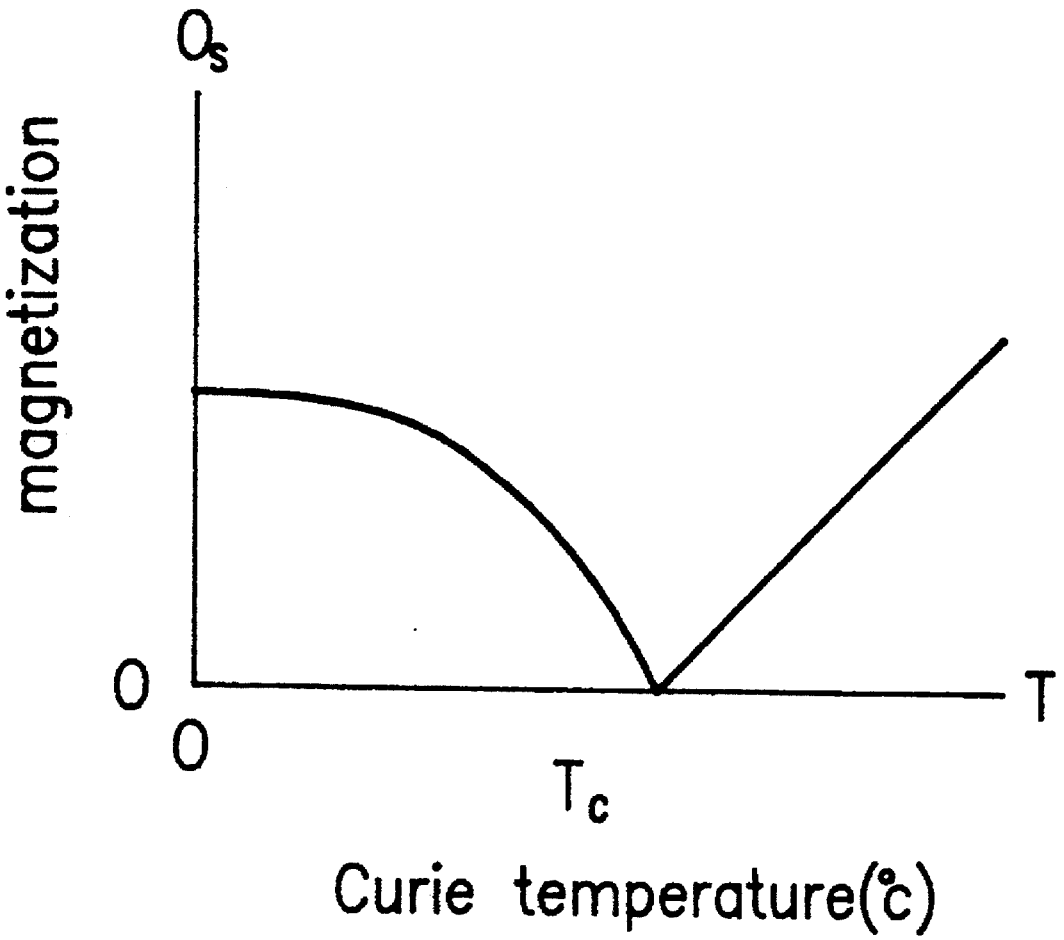
FIG. 1 is a diagram showing that the magnetization of an amorphous soft magnetic material will approach zero when heat treated at a temperature close to its Curie temperature.
Figure 2:
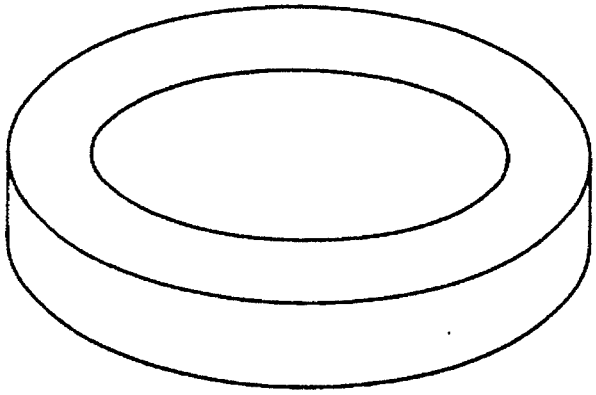
FIG. 2 is a perspective view of the toroidal core used in Example 1.

Several 5 mm wide amorphous alloy ribbons of the composition $Co_{70}Fe_4Ni_2Si_{13}B_{11}$ were formed into toroidal cores of 5 mm in height, 12.5 mm in inner diameter and 17.5 mm in outer diameter as shown in FIG. 2. The $Co_{70}Fe_4Ni_2Si_{13}B_{11}$ amorphous alloy has a $T_c$ (Curie temperature) of about 220° C. and a crystallization temperature of about 530° C. Thereafter, each of the toroidal cores was heated to a temperature of 220° C. in a transverse magnetic field of 1–10 KOe 4 hours, and then the temperature is lowered at a rate less than 5° C./min to room temperature. The transverse magnetic field was applied to the toroidal cores by using the arrangement as depicted in FIG. 3. note that the magnetic field was applied until the temperature had been cooled to room temperature.

The transverse magnetic field was then reduced to 50–1000 Oe, and each of the sample toroidal cores are heated to a temperature of 480° C. and maintained for 1 hour. The temperature was then cooled to room temperature at a rate less than 50° C./min. The initial permeability of each toroidal core was measured by using a HP 4284A LCR meter, and the core loss thereof was measured by using an IRON LOSS MEASURING SYSTEM, MMS-0375, ver 2.1-B (RYOWA ELECTRONICS CO. ,, LTD. JAPAN). The results are summarized in Table 1.

TABLE 1

| Core loss | |
|---|---|
| (50 kHz) | Bm = 0.4 Tesla (36.2 W/kg)<br>Bm = 0.5 Tesla (73.4 W/kg) |
| Initial permeability frequency | initial permeability |
| 1 kHz | 149,405 |
| 10 kHz | 129,538 |
| 50 kHz | 57,431 |
| 100 kHz | 28,989 |
| 200 kHz | 15,679 |
| 300 kHz | 10,848 |
| 400 kHz | 7,265 |
| 500 kHz | 4,321 |
| 1 MHz | 3,336 |

COMPARATIVE EXAMPLE 1

Toroidal cores of the same dimensions and same composition as Example 1 were prepared and were subjected to heat treatment at a temperature of 400° C.–500° C. for 30 minutes to 2 hours without applying a magnetic field thereto. The initial permeability and core loss of each sample toroidal core was measured by the same method as in Example 1, and the results are summarized in Table 2 below.

TABLE 2

| 1. Core loss | |
|---|---|
| 50 kHz | Bm = 0.4 Tesla (44 W/kg)<br>Bm = 0.5 Tesla (78 W/kg) |
| 2. Initial permeability Frequency | Initial permeability |
| 1 kHz | 52,545 |
| 10 kHz | 48,599 |
| 50 kHz | 7,331 |
| 100 kHz | 14,820 |
| 200 kHz | 7,603 |
| 300 kHz | 5,197 |
| 500 kHz | 3,176 |
| 800 kHz | 2,021 |
| 1 MHz | 1,540 |

EXAMPLE 2

Several 5 mm wide amorphous alloy ribbons of the composition $Fe_{78}B_{13}Si_9$ were formed into toroidal cores of 5 mm in height, 12.5 mm in inner diameter and 17.5 mm in outer diameter as shown in FIG. 2. The amorphous alloy has a To (Curie temperature) of about 395° C. and a crystallization temperature of about 500° C. Thereafter, each of the toroidal cores was heated to a temperature of 380° C. in a transverse magnetic field of 1–10 k Oe 0.5 hours, and then the temperature was cooled at a rate less than 5° C./min to room temperature. The transverse magnetic field was applied to the toroidal cores by using the arrangement as depicted in FIG. 3. Note that the magnetic field was applied until the temperature had been cooled to room temperature.

The transverse magnetic field was then reduced to 50–1000 Oe, and each of the sample toroidal cores were heated to a temperature o f 410° C. and maintained for 1 hour. The temperature was then cooled to room temperature at a rate less than 50° C./min. The initial permeability of each toroidal core was measured by using a HP 4284A LCR meter, and the core loss thereof was measured by using an IRON LOSS MEASURING SYSTEM, MMS-0375, ver 2.1-B (RYOWA ELECTRONICS CO., LTD. JAPAN) . The results are summarized in Table 1.

TABLE 3

| Core loss | |
|---|---|
| (20 kHz) | Bm = 0.4 Tesla (23 W/kg)<br>Bm = 1.0 Tesla (167 W/kg) |
| Initial permeability frequency | initial permeability |
| 1 kHz | 9,622 |
| 10 kHz | 9,449 |
| 50 kHz | 9,102, |
| 100 kHz | 8,062 |
| 200 kHz | 6,328 |

COMPARATIVE EXAMPLE 2

Toroidal cores of the same dimensions and same composition as Example 3 were prepared and were subjected to heat treatment at a temperature of 410° C. for 60 minutes without applying a magnetic field thereto. The initial permeability and core loss of each sample toroidal cores was measured by the same method as in Example 1, and the results are summarized in Table 4 below.

TABLE 4

| 1. Core loss | |
|---|---|
| 20 kHz | Bm = 0.4 Tesla (37 W/kg)<br>Bm = 1.0 Tesla (202 W/kg) |
| 2. Initial permeability Frequency | Initial permeability |
| 1 kHz | 5,446 |
| 10 kHz | 5,273 |
| 50 kHz | 5,273 |
| 100 kHz | 4,841 |
| 200 kHz | 4,409 |

It is apparent from the above examples and comparative examples that the amorphous soft magnetic cores which have been subjected to the heat treatment of the invention have higher initial permeability and reduced core loss when compared to the amorphous soft magnetic cores heat treated by the conventional method. By using the heat treatment of the invention the initial permeability of soft amorphous magnetic cores is increased by about 50 percent, and core loss is reduced by about 10 percent.

What is claimed is:

1. A method of heat treating an amorphous soft magnetic article, comprising (a) performing a heat treatment at a first temperature which is equal to or less than the Curie temperature of said amorphorous soft magnetic article said first temperature being 0° C.–50° C. less than the Curie temperature, said heat treatment being performed for not more than 10 hours, said heat treatment occurring while applying a static magnetic field which is larger than 1,000 Oe in a first direction which is perpendicular to the direction the amorphous soft magnetic article is to magnetized when used or measured;

(b) cooling to room temperature at a rate less than 20° C./min; thereafter (e) performing a heat treatment at a second temperature equal to or less than the crystallization temperature of said amorphous soft magnetic article said second temperature being 0° C. to 100° C. less than the crystallization temperature, said heat treatment being performed for not than more than 10 hours, said heat treatment occurring while applying a static magnetic field which is between 50 Oe and 1000 Oe in said first direction; and (d) cooling to room temperature.

2. The method as claimed in claim 1, wherein said amorphous soft magnetic article is made of a Fe-base amorphous alloy.

3. The method as claimed in claim 1, wherein said amorphous soft magnetic article is made of a Ni-base amorphous alloy.

4. The method as claimed in claim 1, wherein said amorphous soft magnetic article is made of a Co-base amorphous alloy.

5. The method as claimed in claim 1, wherein said Co-base amorphous alloy has a composition of $Co_{70}Fe_4Ni_2Si1_3B_{11}$.

6. The method as claimed in claim 1, wherein said Fe-based amorphous alloy has a composition of $Fe_{78}B_{13}Si_9$.

7. The method as claimed in claim 1, wherein in step (g) said second temperature is cooled at a rate less than 200° C./min.

8. The method as claimed in claim 1, wherein said magnetic field used in step (a) and step (d) is a DC magnetic field.

9. The method as claimed in claim 1, wherein said magnetic field used in step (a) and step (d) is a AC magnetic field.

10. The method as claimed in claim 1, wherein said magnetic field used in step (a) and step (d) is generated by a Helmholtz coil.

11. The method according to claim 1 wherein in step (d) the cooling occurs at a rate less than 200° C./min.

* * * * *